US012158303B2

(12) United States Patent
Schwenk et al.

(10) Patent No.: US 12,158,303 B2
(45) Date of Patent: Dec. 3, 2024

(54) METHOD FOR OBTAINING ONE OR MORE AIR PRODUCTS AND AIR SEPARATION SYSTEM

(71) Applicant: Linde GmbH, Pullach (DE)

(72) Inventors: Dirk Schwenk, Aschheim (DE); Dimitri Golubev, Geretsried (DE)

(73) Assignee: LINDE GMBH, Pullach (DE)

( * ) Notice: Subject to any disclaimer, the term of this patent is extended or adjusted under 35 U.S.C. 154(b) by 876 days.

(21) Appl. No.: 17/277,595

(22) PCT Filed: Oct. 8, 2019

(86) PCT No.: PCT/EP2019/025332
§ 371 (c)(1),
(2) Date: Mar. 18, 2021

(87) PCT Pub. No.: WO2020/074120
PCT Pub. Date: Apr. 16, 2020

(65) Prior Publication Data

US 2022/0026145 A1 Jan. 27, 2022

(30) Foreign Application Priority Data

Oct. 9, 2018 (EP) ..... 18020489

(51) Int. Cl.
*F25J 3/04* (2006.01)

(52) U.S. Cl.
CPC ..... *F25J 3/04496* (2013.01); *F25J 3/04018* (2013.01); *F25J 3/0409* (2013.01);
(Continued)

(58) Field of Classification Search
CPC .... F25J 3/04496; F25J 3/04018; F25J 3/0409; F25J 3/04206; F25J 3/04303;
(Continued)

(56) References Cited

U.S. PATENT DOCUMENTS 4,251,248 A * 2/1981 Iyoki ..... F25J 3/04412 62/651
5,224,336 A * 7/1993 Agrawal ..... F25J 3/04563 62/656

(Continued)

FOREIGN PATENT DOCUMENTS

EP 2963367 A1 1/2016
EP 2980514 A1 2/2016
JP 07328421 A * 12/1995 ..... A61K 8/27

*Primary Examiner* — Miguel A Diaz
*Assistant Examiner* — Ibrahim A. Michael Adeniji
(74) *Attorney, Agent, or Firm* — MILLEN, WHITE, ZELANO & BRANIGAN, P.C.; Brion P. Heaney

(57) ABSTRACT

A method for obtaining one or more air products, wherein an air separation system having a rectification column system is used, in which pressurized air is processed in an adjustable total air volume, wherein the total air volume is set to a first value during a first operating period and set to a second value that is different from the first value during a second operating period, and wherein the setting of the total air volume is changed from the first value to the second value in a third operating period from a first time to a second time. The second operating period is after the first operating period, the third operating period is between the first operating period and the second operating period. In the third operating period, a setting of a volume of a fluid, is changed from a third time up to a fourth time.

19 Claims, 4 Drawing Sheets

(52) U.S. Cl.
CPC ..... *F25J 3/04206* (2013.01); *F25J 3/04303* (2013.01); *F25J 3/04412* (2013.01); *F25J 3/0449* (2013.01); *F25J 2250/40* (2013.01); *F25J 2250/50* (2013.01); *F25J 2290/62* (2013.01)

(58) Field of Classification Search
CPC .... F25J 3/04412; F25J 3/0449; F25J 2250/40; F25J 2250/50; F25J 2290/62; F25J 3/0483; F25J 3/04836
See application file for complete search history.

(56) References Cited

U.S. PATENT DOCUMENTS

| | | | | | |
|---|---|---|---|---|---|
| 5,901,579 | A * | 5/1999 | Mahoney | F25J 3/04381 | 62/910 |
| 5,901,580 | A * | 5/1999 | Darredeau | F25J 3/0449 | 62/913 |
| 6,006,546 | A * | 12/1999 | Espie | F25J 3/04575 | 700/270 |
| 6,185,960 | B1 | 2/2001 | Voit | | |
| 2016/0356547 | A1 * | 12/2016 | Goloubev | F25J 3/04084 | |

* cited by examiner

METHOD FOR OBTAINING ONE OR MORE AIR PRODUCTS AND AIR SEPARATION SYSTEM

The invention relates to a method for obtaining one or more air products, and a corresponding air separation system according to the respective preambles of the independent claims.

PRIOR ART

The production of air products in the liquid or gaseous state by low-temperature separation of air in air separation systems is known and is described, for example, in H.-W. Häring (editor), Industrial Gases Processing, Wiley-VCH, 2006—in particular, section 2.2.5, "Cryogenic Rectification."

Air separation systems have rectification column systems which can be designed, for example, as two-column systems—in particular, as classical Linde double-column systems—but also as three-column or multi-column systems. In addition to the rectification columns for obtaining nitrogen and/or oxygen in the liquid and/or gaseous state, i.e., the rectification columns for nitrogen-oxygen separation, rectification columns for obtaining further air components—in particular, the noble gases krypton, xenon, and/or argon—can be provided. Even if rectification columns for obtaining other air components are not specifically discussed below, air separation systems with corresponding rectification columns can also be the subject matter of the present invention at any time.

The rectification columns of the mentioned rectification column systems are operated at different pressure levels. Double-column systems have what is known as a high-pressure column (also referred to as a pressure column, medium-pressure column, or lower column) and what is known as a low-pressure column (also referred to as an upper column). The pressure level of the high-pressure column is, for example, 4.7 to 6.7 bar—preferably, approximately 5.5 bar. The low-pressure column is operated at a pressure level of, for example, 1.3 to 1.8 bar—preferably, approximately 1.4 bar. The pressure levels indicated here and in the following are absolute pressures present at the head of the mentioned columns. The mentioned values are merely examples that can be changed if necessary.

U.S. Pat. No. 4,251,248 A discloses a method and an apparatus for automatically changing operating procedures in an air separation system in order to increase or decrease the product quantities. Intended change values—inter alia for feed air—are always calculated from the values of the correspondingly increased or reduced product quantities.

In U.S. Pat. No. 5,901,580 A, when there are fluctuations in the demand for one of the products, the quantity, or the pressure of the feed air, purities of air products are kept substantially constant by introducing an excess of nitrogen-rich liquid into the rectification column system as the demand for the product or the amount of feed air increases, and by removing and storing excess nitrogen-rich liquid from the distillation device as the demand for the product or the amount of feed air decreases.

A cryogenic air separation system subject to periods with significant changes in product demand is the subject matter of U.S. Pat. No. 6,006,546 A. The system is specifically controlled during these periods in order to minimize the effects of transient operation on product purity.

Rapid changes in the oxygen demand and the feed air pressure are, according to U.S. Pat. No. 5,224,336 A, compensated for by a net transfer of the cold in the form of liquid nitrogen into and out of the distillation system. This cold is transferred using a reservoir for liquid nitrogen which is connected to the return path of the distillation system.

In a method proposed in U.S. Pat. No. 6,185,960 B1 for producing a pressurized gaseous product by cryogenic separation of air, this is done temporarily in a gas mode and temporarily in a combined mode using internal compression and corresponding generation of cold.

Irrespective of the specific design of an air separation system, flexible operation is often desired, i.e., a corresponding air separation system shall be able to provide significantly greater or smaller quantities of certain air products with correspondingly higher or lesser air usage at specific times. In this context, a rapid switchover between such operating states with different production quantities is frequently also desired. Corresponding switching processes are also referred to below as "load changes." It can be assumed that rapid load changes result in an overall higher efficiency of an air separation system. Furthermore, in the event that rapid load changes are implemented, backup reservoirs with a smaller capacity are required, since less or no fluid is withdrawn from such backup reservoirs to support the load changes. It can therefore be assumed that the production costs of corresponding air separation systems are lessened.

The aim of the present invention is to make the production of air products more flexible using air separation systems, and to enable faster load changes overall.

DISCLOSURE OF THE INVENTION

This aim is achieved by a method for obtaining one or more air products, and a corresponding air separation system with the particular features of the independent claims. Advantageous embodiments are the subject matter of the particular dependent claims and the following description.

In the following, some terms used in describing the present invention and its advantages, as well as the underlying technical background, will first be explained in more detail.

So-called main air compressor/booster air compressor (MAC-BAC) methods or so-called high air pressure (HAP) methods can be used for air separation. The main air compressor/booster air compressor methods are the more conventional methods, and high air pressure methods have been used increasingly as alternatives in recent times. The present invention is suitable for both applications.

Main air compressor/booster air compressor methods are distinguished in that only a part of the total amount of feed air supplied to the rectification column system is compressed to a pressure level which is substantially, i.e., at least 3, 4, 5, 6, 7, 8, 9, or 10 bar, above the pressure level of the high-pressure column. Another part of the amount of feed air is compressed only to the pressure level of the high-pressure column, or to a pressure level which differs by no more than 1 to 2 bar from the pressure level of the high-pressure column, and is fed into the high-pressure column at this lower pressure level. An example of a main air compressor/booster air compressor method is shown in Häring (see above) in FIG. 2.3A.

In a high air pressure method, on the other hand, the entire quantity of feed air supplied overall to the rectification column system is compressed to a pressure level which is substantially, i.e., at least 3, 4, 5, 6, 7, 8, 9, or 10 bar, above the pressure level of the high-pressure column. The pressure difference can be, for example, up to 14, 16, 18, or 20 bar.

High air pressure methods are known, for example, from EP 2 980 514 A1 and EP 2 963 367 A1.

The present invention can be used in air separation systems with so-called internal compression (IC), but also in air separation systems with external compression. With internal compression, at least one product provided by means of the air separation system is formed by extracting a cryogenic liquid from the rectification column system, subjecting it to a pressure increase in a liquid state and, depending upon the given pressure, converting it into either the gaseous or supercritical state by heating. For example, internally-compressed gaseous oxygen (GOX IC), internally-compressed gaseous nitrogen (GAN IC), or internally-compressed gaseous argon (GAR IC) can be generated by internal compression. Internal compression offers a number of technical advantages over external compression of corresponding products, which is also possible in principle, and is explained in the professional literature, e.g., in Häring (see above), section 2.2.5.2, "Internal Compression."

Liquids and gases may, in the terminology used herein, be rich or poor in one or more components, wherein "rich" can refer to a content of at least 90%, 95%, 99%, 99.5%, 99.9%, or 99.99%, and "poor" can refer to a content of at most 10%, 5%, 1%, 0.1%, or 0.01% on a molar, weight, or volume basis.

In the terminology used herein, liquids and gases may also be enriched in or depleted of one or more components, wherein these terms refer to a content in a starting liquid or a starting gas from which the liquid or gas in question has been extracted. The liquid or the gas is "enriched" if it contains at least 1.1 times, 1.5 times, 2 times, 5 times, 10 times, 100 times, or 1,000 times the content, and "depleted" if it contains at most 0.9 times, 0.5 times, 0.1 times, 0.01 times, or 0.001 times the content of a corresponding component, based upon the starting liquid or the starting gas. If, by way of example, reference is made here to "oxygen," this is also understood to mean a liquid or a gas which is rich in oxygen, but need not consist exclusively of it.

The present application uses the terms, "pressure level" and "temperature level," to characterize pressures and temperatures, which means that pressures and temperatures in a corresponding system do not have to be used in the form of exact pressure or temperature values in order to realize the inventive concept. However, such pressures and temperatures typically fall within certain ranges that are, for example, ±1%, 5%, 10%, or 20% around an average. In this case, corresponding pressure levels and temperature levels can be in disjointed ranges or in ranges which overlap one another. In particular, pressure levels, for example, include unavoidable or expected pressure losses. The same applies to temperature levels. The pressure levels indicated here in bar are absolute pressures.

ADVANTAGES OF THE INVENTION

Depending upon the "direction" of the load changes explained at the outset (from higher to lower production quantity or vice versa), in conventional air separation systems, either an excess or a deficit of cryogenic liquids in the rectification part, i.e., the rectification column system, relative to the subsequent load state to be set, results. The reason for this is the amount of cryogenic liquids stored in each case on the separating trays or in liquid distributors and packings of the rectification columns—in particular, the high- and low-pressure column. This amount of liquid is load-dependent: The lower the load, the less liquid is distributed onto the separating trays. When the load is reduced, excess liquid is thus released. This excess liquid should be stored in the system in order to be able to use it again when the load is increased in order to compensate for the deficit which is then present.

In conventional air separation systems without argon production, only the sump of the high-pressure column is suitable as a reservoir for the liquid. Further liquid containers, present in corresponding air separation systems, e.g., for the main condenser connecting the high- and low-pressure column in order to exchange heat, or a so-called secondary condenser, should typically be operated with an unchanged liquid level for safety reasons and are therefore not used as storage containers for load changes. More information will be provided below with reference to FIG. 1, which shows a corresponding air separation system. It goes without saying that, for rapid load changes, "rapid" controllers are also required, which lead only to small deviations between the desired and actual values.

Rapid load changes can lead to altered product compositions. If, for example, the air separation system illustrated in FIG. 1 is operated at an increased load change speed (75% load to 100% load at 4% per minute) while operation remains otherwise unchanged, an increase in the oxygen content in the gaseous overhead product of the high-pressure column is, among other things, observable, as also illustrated in FIG. 2 (see trace 103 therein). This increase is considered problematic, since it impairs the purity of at least two air products, viz., a liquid compressed nitrogen product (LIN) formed by liquefaction from the overhead product of the high-pressure column and a fraction of this overhead product discharged unliquefied from the air separation system in the form of a gaseous compressed nitrogen product (PGAN).

An obvious solution for avoiding a corresponding deterioration of product purities would be to operate the system with a product purity that includes a certain buffer for such operating states, so that the required purity can always be maintained A disadvantage of this, however, is that, for most operating states, a greater product purity than is actually required must be provided. This would therefore lead either to higher investment costs (more separation stages in the high-pressure column) or to higher operating costs (due to an excess of feed air).

In the context of the present invention, it was recognized that the explained problems can be solved by undertaking a delayed or preliminary setpoint value adjustment of controllers, which influence the quantity of a flow of air conducted into or out of the rectification column system in an air separation system, in response to a change in the amount of air processed in the air separation system or its rectification column system. In particular, as described in key points below, this can take place in the form of a delayed setpoint value adjustment, and in particular with regard to the quantity of a nitrogen-rich liquid, which is formed from an overhead product of the high-pressure column. However, the present invention is not limited to this specific case. Rather, the basic realization of the invention is that a previous or subsequent adjustment of corresponding fluid flows or their quantities can be particularly advantageous in corresponding scenarios of use.

Against this backdrop, the present invention proposes a method for obtaining one or more air products, wherein an air separation system with a rectification column system is used in which pressurized air is processed in an adjustable total air volume. In this context, when a "total air volume" is mentioned, it is always understood to mean the total amount of air processed in a corresponding plant at a particular time, i.e., treated by rectification. In this process, additional air besides the total air volume is never processed in the air separation system or in its rectification column system.

In the context of the present invention, the total air volume is set to a first value during a first operating period and to a second value differing from the first value during a second operating period. Thus, there are different total air volumes in these two operating periods, wherein the first total air volume may be larger or smaller than the second total air volume. Thus, a corresponding air separation system is operated in different load states during the first and the second operating period, wherein full load operation can exist or occur, in particular, in one of the two operating periods. In other words, the present invention relates to instances of a load increase and a load reduction.

In the context of the present invention, as is known in principle, the adjustment of the total air volume from the first value to the second value is changed in a third operating period from a first time and up to a second time, i.e., a load change is carried out. It is understood thereby that the second operating period is after the first operating period, and the third operating period is between the first operating period and the second operating period. Without additional measures, this can lead, as mentioned, to the explained disadvantageous effects. A load change can be a load increase or load reduction, depending upon whether the first total air volume is less than or higher than the second total air volume. In this case, the first, second, and third operating time periods represent non-overlapping operating time periods, and the third operating time period is always chronologically between the first and the second, or the second and the first, operating time period. This does not preclude the existence of additional operating periods.

According to the invention, in the third operating period, a setting of a volume of a fluid, which is formed via rectification using the pressurized air and transported into or out of the rectification column system, is changed from a third time and up to a fourth time, wherein the third time is before or after the first time and before the second time, and the fourth time is after the first time and the third time and before or after the second time. The first, second, third, and fourth points in time are each within the third operating time period, wherein, however, the third, for example, may be before the first, or the fourth may be after the second time, i.e., the third operating time period does not have to start at the first time and end at the second time. The third operating time period may lie between the earliest time and the latest time of these points in time, but may also extend over a longer period of time. According to the invention, a time period between the first time and the second time is set such that it differs by not more than 20%, 10%, 5%, or 1% from a time period between the third time and the fourth time. The stated time periods can also be set to be the same, or substantially the same. The adjustment can be made, in particular, by using corresponding setpoint values or default values in a closed-loop or open-loop control system.

Thus, within the scope of the present invention, a time change, asynchronous with the change in the total air volume, of the quantity of fluid formed by rectification using pressurized air and transported into or out of the rectification column system is proposed. This change is made, in particular, by a corresponding setpoint value entry of an open-loop control or closed-loop control system of an air separation system and is performed by suitable actuators—in particular, valves, slides, and the like. A corresponding open-loop or closed-loop control system can, in particular, be based upon detected actual values and thereby comprise all the measures known from the field of open-loop or closed-loop control engineering, insofar as they are suitable and appropriate for use in the present invention.

The quantity of fluid which is formed by rectification using the pressurized air and transported into or out of the rectification column system can be changed, in particular, by using a corresponding setpoint value entry. In certain cases, e.g., in the air separation systems shown in the accompanying FIGS. 1 through 4, a corresponding controller output may additionally be readjusted (typically within a range of not more than ±5%) by a trim control. As a result, in an extreme case, an actual value at the end of the adjustment may differ slightly (but not by more than 5%) from a given setpoint value.

The present invention can be used, in particular, in air separation systems whose rectification column system has a high-pressure column operated at a first pressure level and a low-pressure column operated at a second pressure level below the first pressure level, wherein the liquid, whose quantity is changed in the third operating period, is, as mentioned, a fraction of a gaseous, nitrogen-rich overhead product of the high-pressure column, liquefied and fed as reflux to the low-pressure column. The present invention can be used, in particular, in an air separation system with a secondary condenser for heating an internally-compressed oxygen product. In a corresponding air separation system, internal or external compression of air products can be carried out, and process-engineering interconnections to nitrogen and air circuits can be used. Air separation systems with several high-pressure columns can also be used.

Regardless of the number of high- and low-pressure columns, the first pressure level, in the context of the present invention, can, in particular, be 5 or 7 to 12 bar absolute pressure, and the second pressure level can, in particular, be 1.3 or 1.8 to 3.5 bar absolute pressure. The present invention can therefore be used, in particular, for so-called "elevated pressure" air separation systems in which the operating pressures of the distillation column systems lie above the conventional values mentioned at the outset. However, the invention can also be used in connection with conventional pressure levels in the distillation column system.

In particular, flexible load changing speeds can be realized within the scope of the present invention. In other words, a time period between the first time and the second time can be set by changing the first time and/or the second time. In this context, it has proven to be particularly advantageous if, for example, a delay time provided within the scope of the present invention is adapted to this change, i.e., when a time period between the first time and the third time is set as a function of the setting of the time period between the first time and the second time by changing the third time. In this way, the advantages according to the invention can be achieved even when the load change rates have changed. In this case, it can be provided, in particular, that, when the third time lies after the first time and the fourth time lies after the second time, the time period between the first time and the third time be lengthened if the time period between the first time and the second time is shortened. In other words, when the load change speed is increased, a longer delay time may be selected, for example.

In the context of the present invention, a load change can, in particular, also include the change in the quantities of the respective air products formed. Thus, one or more air products can be formed in an adjustable product quantity, wherein the product quantity is set to a first value during the first operating period and to a second value differing from the first value during the second operating period, and wherein the setting of the product quantity is changed from the first value to the second value during the third operating period from the first time and up to the second time. A corresponding air product can, in particular, be such an air product, which is at least partially formed from the gaseous, nitrogen-rich overhead product of the high-pressure column. This can be provided in liquefied or unliquefied form.

The present invention can be used in connection with different load change scenarios. For example, it can be provided that the first total air volume differ from the second total air volume by more than 5 and up to 30, 40, or 50 percent. In particular, the total air volume can be changed stepwise or continuously during the third operating period, and preferably with an average rate of change (relative to a stepwise change) or a rate of change (during a continuous change) of the total air volume of 0.1 (in the case of argon recovery) or 1 to 10 percent per minute.

In general, argon recovery can fall within the scope of the present invention, i.e., during the process, the rectification column system can have, in particular, one or more rectification columns designed to recover an argon-rich air product, and the argon-rich air product can be formed in the process. An "argon-rich" air product has at least 50, 60, 70, 80, or 90 mole percent argon.

The present invention also extends to an air separation system that is configured to obtain one or more air products and has a rectification column system, wherein the air separation system is configured to process pressurized air in an adjustable total air volume in the rectification column system, and to thereby set the total air volume to a first value during a first operating period and to a second value that is different from the first value during a second operating period, and to change the setting of the total air volume from the first value to the second value in a third operating period from a first time and up to a second time. As mentioned, the second operating period is after the first operating period, and the third operating period is between the first operating period and the second operating period.

According to the invention, the air separation system is equipped with a control unit that is programmed to change, in the third operating period, a setting of a volume of a fluid which is formed by rectification using the pressurized air and transported into or out of the rectification column system as of a third time and up to a fourth time, wherein the third time is before or after the first time and before the second time, and the fourth time is after the first time and the third time and before or after the second time. It is further configured to set a time period between the first time and the second time in such a way that it differs by not more than 20% or another of the aforementioned difference values from a time period between the third time and the fourth time.

The control unit is programmed, in particular, to carry out a method as explained above in different embodiments.

For further advantages of corresponding air separation systems and embodiments according to the invention, reference is expressly made to the above explanations with regard to the method according to the invention and its different advantageous embodiments. An air separation system provided according to the invention is designed, in particular, for carrying out corresponding methods and has specifically designed means for this purpose.

The invention will be explained in more detail below with reference to the accompanying drawings, which show, inter alia, an air separation system that can be operated according to one embodiment of the invention.

DETAILED DESCRIPTION OF THE DRAWINGS

Figure 1:
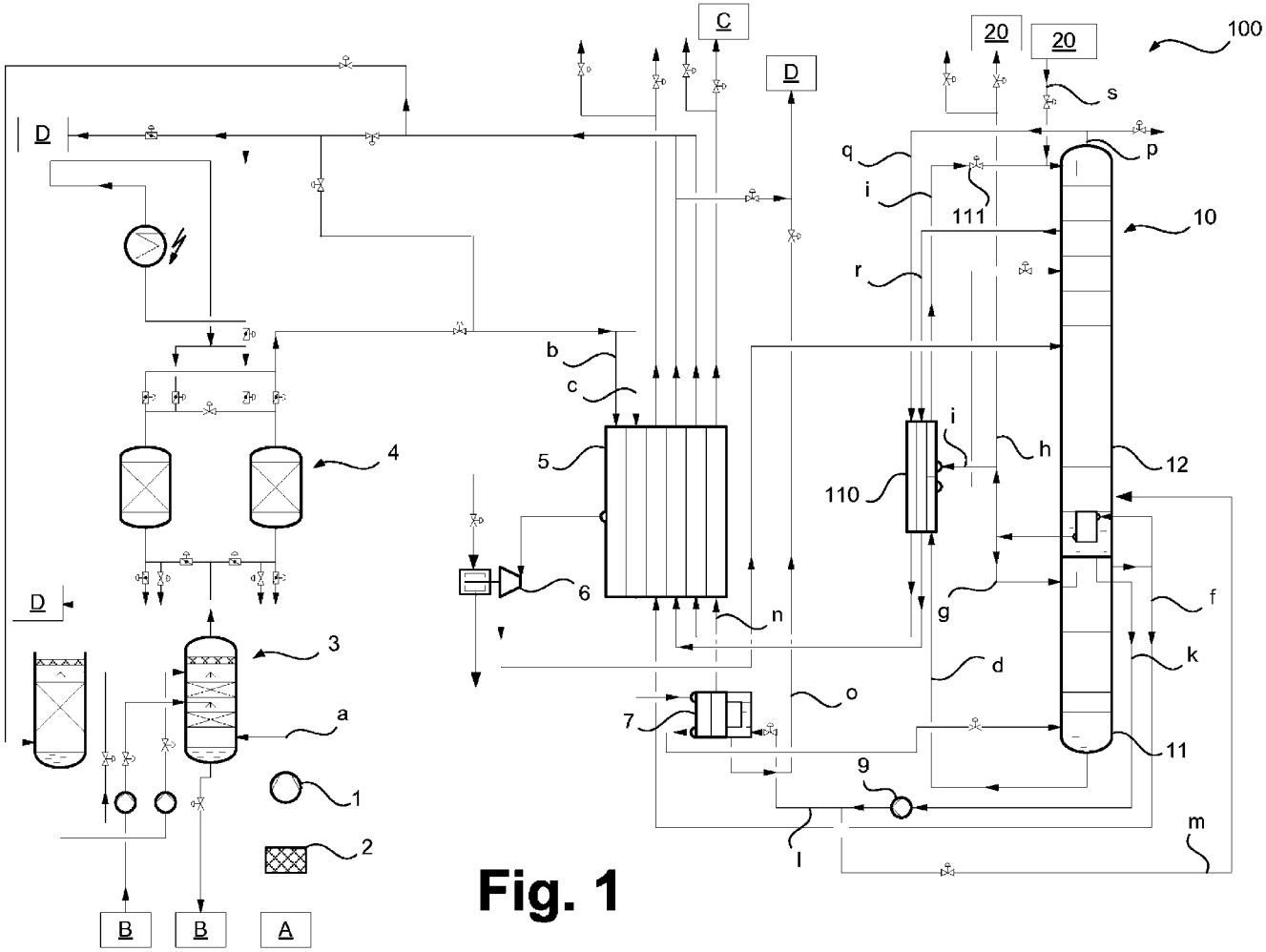
FIG. 1 shows an air separation system which can be operated in the form of a simplified process flow diagram, according to one embodiment of the invention.

In FIG. 1, an air separation system that can be operated according to one embodiment of the invention is illustrated in the form of a process flow diagram, and is identified as a whole by 100. With regard to the components of the shown air separation system 100 which are not explained below, reference is made to the relevant professional literature—in particular, the aforementioned chapter by Häring. The air separation system 100 has a distillation column system 10 comprising a high-pressure column 11 and a low-pressure column 12.

In the air separation system 200, feed air (A) is suctioned and compressed by means of a main air compressor 1 via a filter 2. A correspondingly-formed compressed-air flow "a" is precooled and purified in a precooling device 3 operated with cooling water (B) and a purification device 4 in a basically known manner. Air of the precooled and purified pressurized air flow "a" is supplied to a main heat exchanger 5 in the form of two partial flows "b" and "c."

The partial flow "b" is taken from the main heat exchanger 5 at an intermediate temperature level and is expanded (blown in) in the low-pressure column 12 by means of a blowing turbine 6 that can be coupled to an oil brake or a generator, which is not designated separately. In contrast, the partial flow "c" is taken from the main heat exchanger 5 at the cold side, guided through a secondary condenser 7, and fed into the high-pressure column 11 via a valve, which is not separately identified.

In the high-pressure column 11, an oxygen-enriched, liquid bottom product and a nitrogen-enriched or nitrogen-rich, gaseous overhead product forms. The bottom product of the high-pressure column 11 is guided through a cooling counter-flow heat exchanger 8 in the form of a material flow "d" and fed into the low-pressure column 12. The overhead product of the high-pressure column 11 is liquefied partly in the form of a material flow "e" in a main condenser 13, which interconnects the high-pressure column 11 and the low-pressure column 12 for exchanging heat, and is partially heated in the form of a material flow "f" in the main heat exchanger 5 and discharged from the system as a gaseous, compressed nitrogen product. The liquefied fraction is partly returned as reflux to the high-pressure column 11 in the form of a material flow "g" and, in particular, fed into a tank 20 in additional, adjustable fractions, on the one hand, in the form of a material flow "h," and, on the other, is guided in the form of a material flow "i" through the counter-flow heat exchanger 8 and added to the low-pressure column 12.

In the low-pressure column 12, an oxygen-rich, liquid bottom product is formed and pressurized in a liquid state in the form of a material flow "k" in an internal compression pump 9. At least a part thereof can be supplied to the secondary condenser 7 in the form of a material flow "l" and heated there. If necessary, another fraction in the form of a material flow "m" can be fed back into the low-pressure column 12 by a valve that is not separately identified.

In the secondary condenser 7, the material flow "l" is, at least predominantly, evaporated. A correspondingly evaporated material flow "n" is heated in the main heat exchanger 5, converted from a liquid to a gaseous or supercritical state, and discharged from the air separation system 100 as a gaseous, compressed oxygen product (C). A fill-level in a liquid container of the secondary condenser 7 is regulated by the feed flow "l." If necessary, liquid in the form of a material flow "o" can be released to the atmosphere (D). A liquid level in the liquid container of the secondary condenser 7, but also a liquid level in the low-pressure column 12, and thus in a liquid container of the main condenser 13, should, as mentioned, be kept constant for safety reasons. Thus, in the air separation system 100 illustrated here, basically, the sump of the high-pressure column 11 remains as a possible fluid reservoir for load changes.

In the air separation system illustrated here, overhead gas in the form of a material flow "p" is drawn off from the head of the low-pressure column 12 and guided partly in the form of a material flow "q" through the counter-flow heat exchanger 8 and the main heat exchanger 5, and heated thereby. The same applies to so-called impurities which are withdrawn from the low-pressure column 12 in the form of a material flow "r." The last-mentioned material flows can be used in different ways in the air separation system 100, provided as a product, and/or released to the atmosphere (D).

The tank 20 can be used, in particular, to buffer a reflux to the low-pressure column 12. In other words—particularly if the nitrogen-rich liquid which can be provided in the form of the material flow "i" is not sufficient for operating the low-pressure column 12 in certain operating states—corresponding supplementation can occur with a material flow "s" from the tank 20, and, if the quantity of such nitrogen-rich liquid exceeds the demand for product or the demand in the air separation system 100, feeding into the tank 20 can be undertaken.

Figure 2:
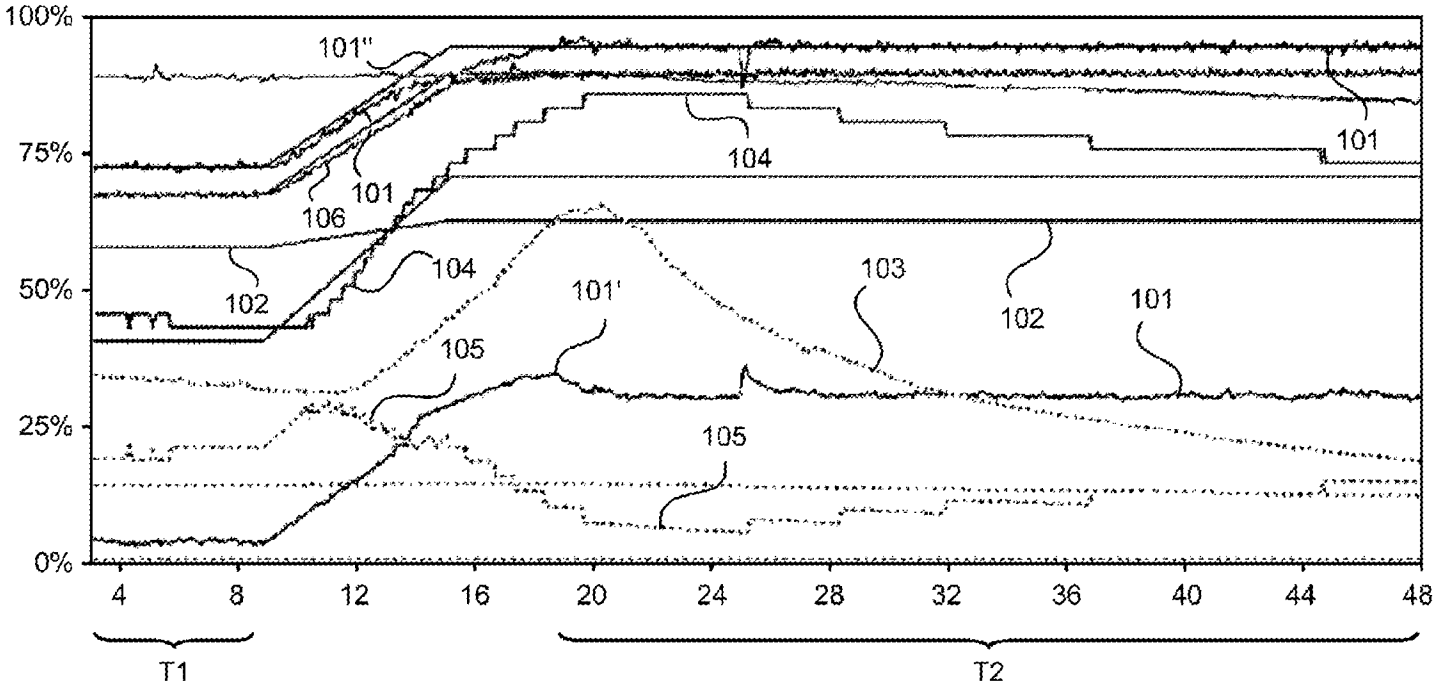
FIG. 2 shows changes in material flows and compositions thereof in a method that is not according to the invention, in the form of a graph.

FIG. 2 shows changes in material flows and their compositions in a method not according to the invention in the form of a graph, wherein a time in minutes is plotted on the x-axis against a standardized range of values from 0 to 100% on the y-axis. The depiction in FIG. 1 corresponds to that of FIGS. 3 and 4, wherein, in the latter, corresponding changes in material flows and their compositions are illustrated in a method according to one embodiment of the invention.

As can be seen from FIG. 2, an air quantity 101 fed into a distillation column system of an air separation system, e.g., the air separation system 100 according to FIG. 1, and processed there is set, during a first operating period T1, to a first value and, during a second operating period T2, to a second value differing from the first value. The corresponding guide vane position of the main air compressor is designated 101', and the default (ramp) for the guide vane position is designated 101". The same also applies to the amount of a gaseous, nitrogen-rich overhead product of a high-pressure column of a corresponding system, which is liquefied and fed as a return flow to the low-pressure column. In FIG. 1, such a material flow is designated "i." Its quantity is set by a default (ramp) with respect to the position of a valve 111 which is arranged downstream of a subcooler 110 (see FIG. 1 in each case). This default is designated 102 in FIG. 2. There is no measurement. It goes without saying that the values used in each case differ from one another. Other material flows are also changed in a corresponding manner, but are not illustrated separately here.

As can be seen here, the change in the nitrogen-rich reflux quantity according to the default 102 is ramp-like here, from the same time at the end of the first operating time period T1 as the ramp-like change of the fed and processed air quantity 101. This disadvantageously results here in a temporarily greatly increased oxygen content 103 in an overhead product of the high-pressure column. This is accompanied by a temporary increase in the column temperature 104 of the high-pressure column and a reduction in the column temperature 105 of the low-pressure column. A quantity of an oxygen product withdrawn from the air separation system is designated 106.

Figure 3:
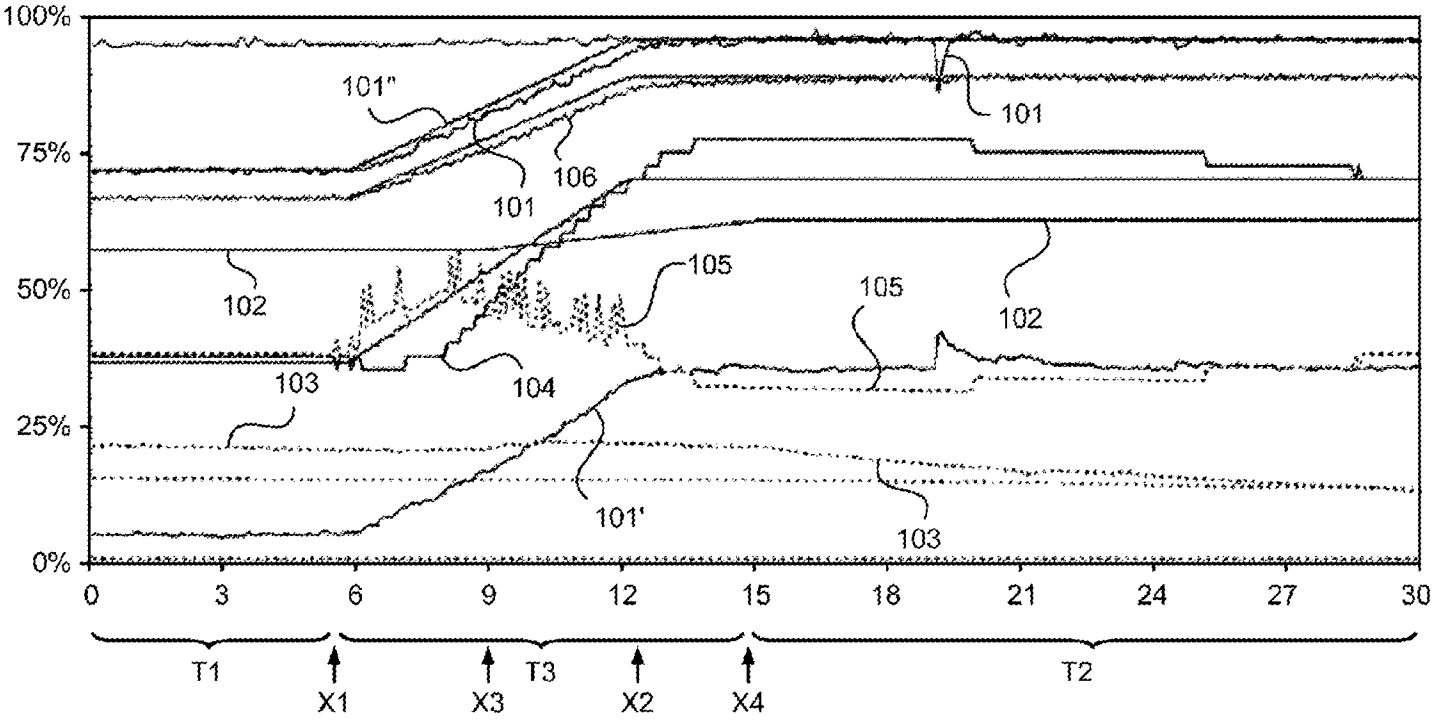
FIG. 3 shows changes in material flows and their compositions in a method according to one embodiment of the invention, in the form of a graph.

During the operation, illustrated in FIG. 3, according to one embodiment of the present invention, a third operating time period T3 is therefore provided in this case. During this time period, as was the case, in principle, beforehand, the air quantity 101 fed into the distillation column system and processed there is changed from the first value to the second value from a first time X1 and up to a second time X2.

In addition, however, it is provided in this case that, in the third operating time period T3, a setting of an amount of a fluid which is formed by rectification using pressurized air and transported into or out of the rectification column system—in this case, namely, the gaseous, nitrogen-rich overhead product of the high-pressure column, which is liquefied and supplied according to the default 102 as a reflux to the low-pressure column—be changed to be slower than the fed and processed air quantity 101—specifically, in this case, starting at a third time X3 and up to a fourth time X4. In this case, the third time X3 is after the first time X1 and before the second time X2, and the fourth time X4 is after the first time X1 and the third time X3 and after the second time X2.

Figure 4:
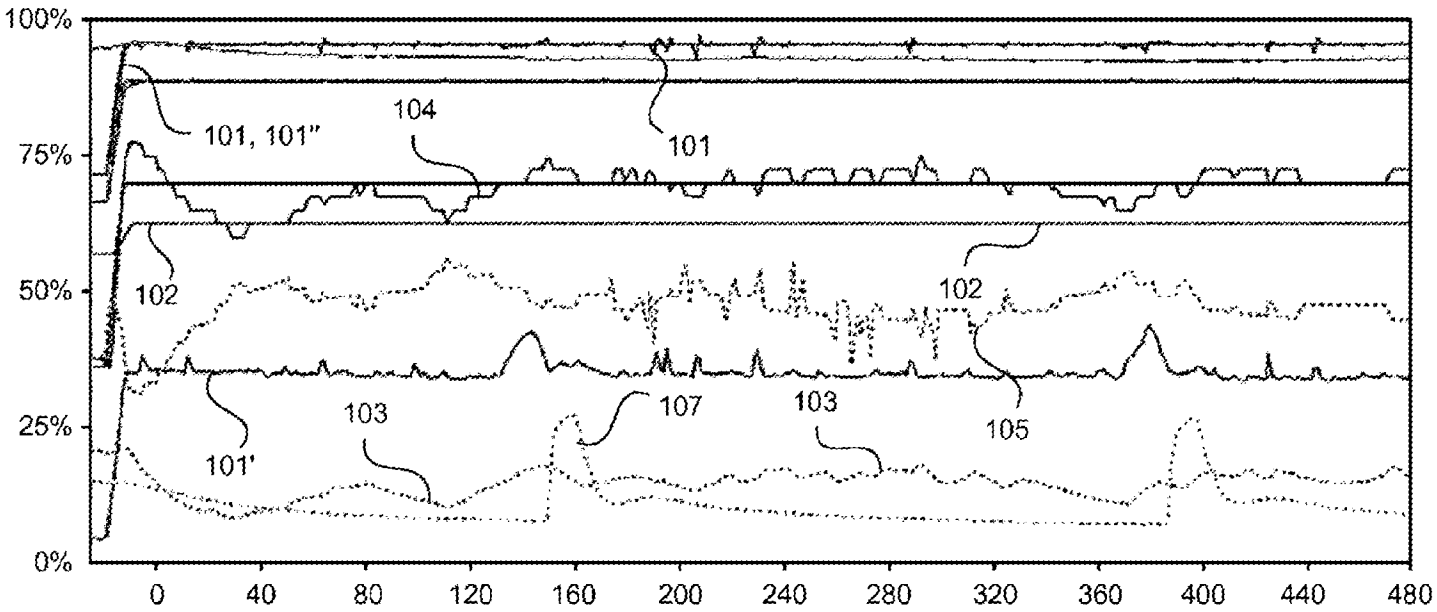
FIG. 4 shows changes in material flows and their compositions in a method according to one embodiment of the invention, in the form of a graph.

The depiction according to FIG. 4 corresponds to the depiction according to FIG. 3 over an extended period of time. As further illustrated here, "purge" oxygen 107 is periodically vented into the atmosphere (see flow "o" in FIG. 1) to prevent accumulation of unwanted components. This can, in principle, also be injected into the compressed oxygen product (C).

As can be seen from FIGS. 3 and 4, when the present invention is used in the depicted embodiments, there is, in particular, no deterioration in the purity of a nitrogen product (see in each case the oxygen content 103 in the overhead product of the high-pressure column).

The invention claimed is:

1. A method for obtaining one or more air products using an air separation system having a rectification column system wherein pressurized air is processed in an adjustable total air volume of air to be processed, comprising:

setting the total volume of air to be processed to a first value during a first operating period and setting the total volume of air to be processed to a second value that is different from the first value during a second operating period, wherein the setting of the total volume of air to be processed is changed from the first value to the second value in a third operating period from a first time and to a second time, and wherein the second operating period is after the first operating period, and the third operating period is between the first operating period and the second operating period, wherein, in the third operating period, a setting of a volume of a fluid, which is formed from pressurized air via the rectification column system and transported into or out of the rectification column system, is changed from a third time and up to a fourth time, wherein the third time is before or after the first time and before the second time, and the fourth time is after the first time and the third time and before or after the second time, and a time period between the first time and the second time is set to not differ by more than 20% from a time period between the third time and the fourth time, wherein the rectification column system has a high-pressure column operated at a first pressure level and a low-pressure column operated at a second pressure level below the first operating pressure, wherein a gaseous, nitrogen-rich overhead product is formed in the low-pressure column, wherein the time period between the first time and the second time is set by changing the first time and/or the second time, wherein the time period between the first time and the third time is set by changing the third time as a function of the setting of the time period between the first time and the second time, and wherein the third time is after the first time, and the fourth time is after the second time, wherein a time period between the first time and the third time is lengthened when the period between the first time and the second time is shortened.

2. The method according to claim 1, wherein the fluid, whose volume is changed in the third operating period, is a fraction of the gaseous, nitrogen-rich overhead product of the high-pressure column, which is liquefied and fed as a return flow to the low-pressure column.

3. The method according to claim 1, wherein the first pressure level is 5 to 12 bar absolute pressure, and the second pressure level is 1.3 to 3.5 bar absolute pressure.

4. The method according to claim 1, wherein one or more air products are formed in an adjustable product quantity, wherein the product quantity is set to a first value during the first operating period and to a second value which differs from the first value during the second operating period, and wherein the setting of the product quantity is changed from the first value to the second value during the third operating period from the first time and up to the second time point.

5. The method according to claim 4, wherein the one or more air products is or are at least partially formed from the gaseous, nitrogen-rich overhead product of the high-pressure column.

6. The method according to claim 1, wherein the first value of the total volume of air to be processed differs from the second value of the total volume of air to be processed by more than 5 and up to 30 percent.

7. The method according to claim 6, wherein the total volume of air to be processed changes stepwise or continuously in during the third operating period.

8. The method according to claim 7, wherein an average rate of change, during the stepwise change, or a rate of change, during the continuous change, of the total air volume in the third operating period is from 0.1 to 10 percent per minute.

9. The method according to claim 1, wherein the rectification column system has one or more rectification columns designed to obtain an argon-rich air product, and wherein argon-rich air product is formed in the process.

10. An air separation system configured for obtaining one or more air products comprising:

a rectification column system, wherein the air separation system having said rectification column system is configured to process pressurized air in an adjustable total air volume in the rectification column system and a total volume of air to be processed is set to a first value during a first operating time period and to a second value different from the first value during a second operating time period, and to change the setting of the total volume of air to be processed from the first value to the second value in a third operating period from a first time and up to a second time, wherein the second operating period is after the first operating period, and the third operating period is between the first operating period and the second operating period, air separation system further comprising a control unit that, in the third operating period, is programmed to change a setting of a volume of a fluid, formed from pressurized air via the rectification system and transported into or out of the rectification column system from a third time and up to a fourth time, wherein the third time is before or after the first time and before the second time, and the fourth time is after the first time and the third time and before or after the second time, and to set a time period between the first time and the second time such that it does not differ by more than 20% from a time period between the third time and the fourth time, wherein the rectification column system has a high-pressure column operated at a first pressure level and a low-pressure column operated at a second pressure level below the first operating pressure, wherein a gaseous, nitrogen-rich overhead product is formed in the low-pressure column, wherein the time period between the first time and the second time is set by changing the first time and/or the second time, wherein a time period between the first time and the third time is set by changing the third time as a function of the setting of the time period between the first time and the second time, and wherein the third time is after the first time, and the fourth time is after the second time, wherein a time period between the first time and the third time is lengthened when the period between the first time and the second time is shortened.

11. The air separation system according to claim 10, wherein the control unit is programmed to execute a method for obtaining one or more air products, using said air separation system having the rectification column system, in which method the total volume of air to be processed is set to said first value during said first operating period and set to said second value during said second operating period, wherein the setting of the total air volume is changed from the first value to the second value in said third operating period from said first time and to said second time, and wherein the second operating period is after the first operating period, and the third operating period is between the first operating period and the second operating period, and wherein, in the third operating period, the setting of the volume of a fluid is changed from said third time and up to said fourth time, wherein the third time is before or after the first time and before the second time, and the fourth time is after the first time and the third time and before or after the second time, and the time period between the first time and the second time is set to not differ by more than 20% from the time period between the third time and the fourth time.

12. The method according to claim 1, wherein the time period between the first time and the second time is set to not differ by more than 10% from the time period between the third time and the fourth time.

13. The method according to claim 1, wherein the first pressure level is 7 to 12 bar absolute pressure, and the second pressure level is 1.8 to 3.5 bar absolute pressure.

14. The method according to claim 1, wherein the first value of the total volume of air to be processed differs from the second value of the total volume of air to be processed by more than 5 and up to 50 percent.

15. The method according to claim 1, wherein the third time is after the first time and before the second time, and the fourth time is after the first time and the third time and after the second time.

16. The air separation system according to claim 10, wherein the time period between the first time and the second time is set to not differ by more than 10% from the time period between the third time and the fourth time.

17. The air separation system according to claim 11, wherein the time period between the first time and the second time is set to not differ by more than 10% from the time period between the third time and the fourth time.

18. The air separation system according to claim 10, wherein the third time is after the first time and before the second time, and the fourth time is after the first time and the third time and after the second time.

19. The air separation system according to claim 11, wherein the third time is after the first time and before the second time, and the fourth time is after the first time and the third time and after the second time.

* * * * *